US005938085A

United States Patent [19]

Conroy et al.

[11] Patent Number: 5,938,085

[45] Date of Patent: Aug. 17, 1999

[54] VALVES FOR DISPENSERS

[75] Inventors: Gary Conroy; David Howlett, both of Kings Lynn, United Kingdom

[73] Assignee: Bespak PLC, King's Lynn, United Kingdom

[21] Appl. No.: 08/838,530

[22] Filed: Apr. 9, 1997

[30] Foreign Application Priority Data

Apr. 9, 1996 [GB] United Kingdom ..... 9607314

[51] Int. Cl.[6] ..... B65D 83/00

[52] U.S. Cl. ..... 222/402.2; 222/402.24

[58] Field of Search ..... 222/402.1, 402.16, 222/402.2, 402.24, 402.25

[56] References Cited

U.S. PATENT DOCUMENTS

| | | | |
|---|---|---|---|
| 4,135,648 | 1/1979 | White | 222/402.2 |
| 4,142,652 | 3/1979 | Platt | 222/402.2 |
| 4,362,257 | 12/1982 | Shay | 222/402.2 |
| 4,413,755 | 11/1983 | Brunet | 222/402.2 |
| 4,506,803 | 3/1985 | Franklin et al. | 222/402.2 |
| 5,083,682 | 1/1992 | Cater | 222/402.2 |
| 5,326,002 | 7/1994 | Dubini | 222/402.24 |
| 5,632,421 | 5/1997 | Colombo | 222/402.2 |

FOREIGN PATENT DOCUMENTS

| | | | |
|---|---|---|---|
| 0 350 376 | 1/1990 | European Pat. Off. . | |
| 9401347 | 1/1994 | WIPO | 222/402.2 |

*Primary Examiner*—Joseph A. Kaufman
*Attorney, Agent, or Firm*—Smith, Gambrell & Russell, LLP; Beveridge, DeGrandi, Weilacher & Young Intellectual Property Group

[57] ABSTRACT

A metering valve for dispensing an accurately metered dose of a product includes a valve stem having at one end a piston extending within and slidable relative to a cup shaped valve body. A spring member urges the piston against a base of the valve body. Movement of the valve stem against the spring action causes the piston to move away from the base of the valve body to define a temporary metering chamber between the valve stem and valve body. A clearance between an outer surface of the piston and an inner surface of the valve body provides a path for the product to flow from the container to the metering chamber. A seal within the container is contacted by an end of the piston to prevent the flow of product along the path, and the product is dispensed from the temporary metering chamber through an outlet in the valve stem.

30 Claims, 6 Drawing Sheets

VALVES FOR DISPENSERS

The invention relates to improvements in valves for dispensers for dispensing an accurately metered dose of a product.

The accuracy of the metered dose of an active drug is very important for dispensing drugs and medicaments and more attention is being paid nowadays to the consistent accuracy of the dose supplied by pharmaceutical dispensing means. Recent investigations have found that in many of the marketed pharmaceutical formulations the first dose could be less than 50% of the label claim with the second dose 50% higher. This discrepancy is thought to lie in the sedimentation of the pharmaceutical product within the dispensing chamber. The size of the chamber is often such that there is no head space which prevents resuspension of the product until the second dose enters the chamber. This phenomenon is linked only with suspension type formulations. Although this might not be such a problem where the dose of pharmaceutical products is provided in two shots such that on average the patient receives the correct dose, this is not generally deemed to be acceptable under the current tightening of requirements.

Another problem which affects suspension formulations is that some are less stable than others and the pharmaceutical product can start to form discrete regions within seconds of the container being shaken. The resulting in-homogeneity can lead to the dispensing chamber being re-filled with a suspension which does not contain the optium concentration of the pharmaceutical. If this is a progressive progress, the resulting concentration of the remaining bulk of the pharmaceutical product will also be influenced. This highlights itself as a progressive drift in the amount of pharmaceutical dispensed through the life of the dispensing pack.

The third problem encountered with many metered dose dispensers is the residue of product left in the container, which cannot effectively be dispensed. This results primarily from the valve geometry and is dependent on the re-fill point of the chamber and its relative position to the can neck. This is known as Ullage and affects both the performance and economy of the dispenser as waste propellant and pharmaceutical products is included in every pack.

Historically metering performance has only been assessed over the label claim number of doses from the pack. However, dispensers are now required which have an improved performance through to the actual emptying of the pack, which eliminates the need for dose counters. The results of ullage is that the last few shots can become erratic as the chamber re-fill point becomes inconsistently exposed during the re-fill cycle.

It is therefore an object of the present invention to provide improved dispensing apparatus which eliminates or reduces these problems.

According to the invention there is provided dispensing apparatus for dispensing a product from a container comprising metering valve means, the valve comprising a valve stem having at one end piston means extending within and slidable relative to a cup shaped valve body, a clearance being provided between an outer surface of the piston means and an inner surface of the valve body to provide a path for said product, a spring member urging the piston means against the base of the chamber body, such that movement of the valve stem against the spring action causes the piston means to move away from the base of the valve body to define a temporary metering chamber between the valve stem and valve body and product to flow from the container along said path to the metering chamber, the dispensing apparatus further comprising sealing means provided within the container such that as an end of the piston means moves into contact with said sealing means, the flow of product along the path is prevented and the product dispensed through an outlet in the valve stem.

Preferably the clearance is an annular clearance in the range of 0.03 to 0.08 mm.

In another preferred embodiment of the invention the metering valve further comprises a housing which covers an open end of the cup shape valve body. The housing may support the sealing means.

Preferably the spring means are located between the housing and the piston means.

In a further embodiment of the invention the housing further comprises stop means which define the limit of travel of the valve stem.

Preferably at least one port is provided in the housing to allow the products access to the inside of the valve.

The sealing means preferably comprises an elastomeric annular sliding seal.

Preferably the sealing means has a flexible cylindrical portion bearing a sealing bead which contacts the piston means to affect the seal.

In a preferred embodiment of the invention the piston means is open at one end.

A preferred embodiment of the present invention is described with reference to the accompanying drawings in which.

Figure 1:
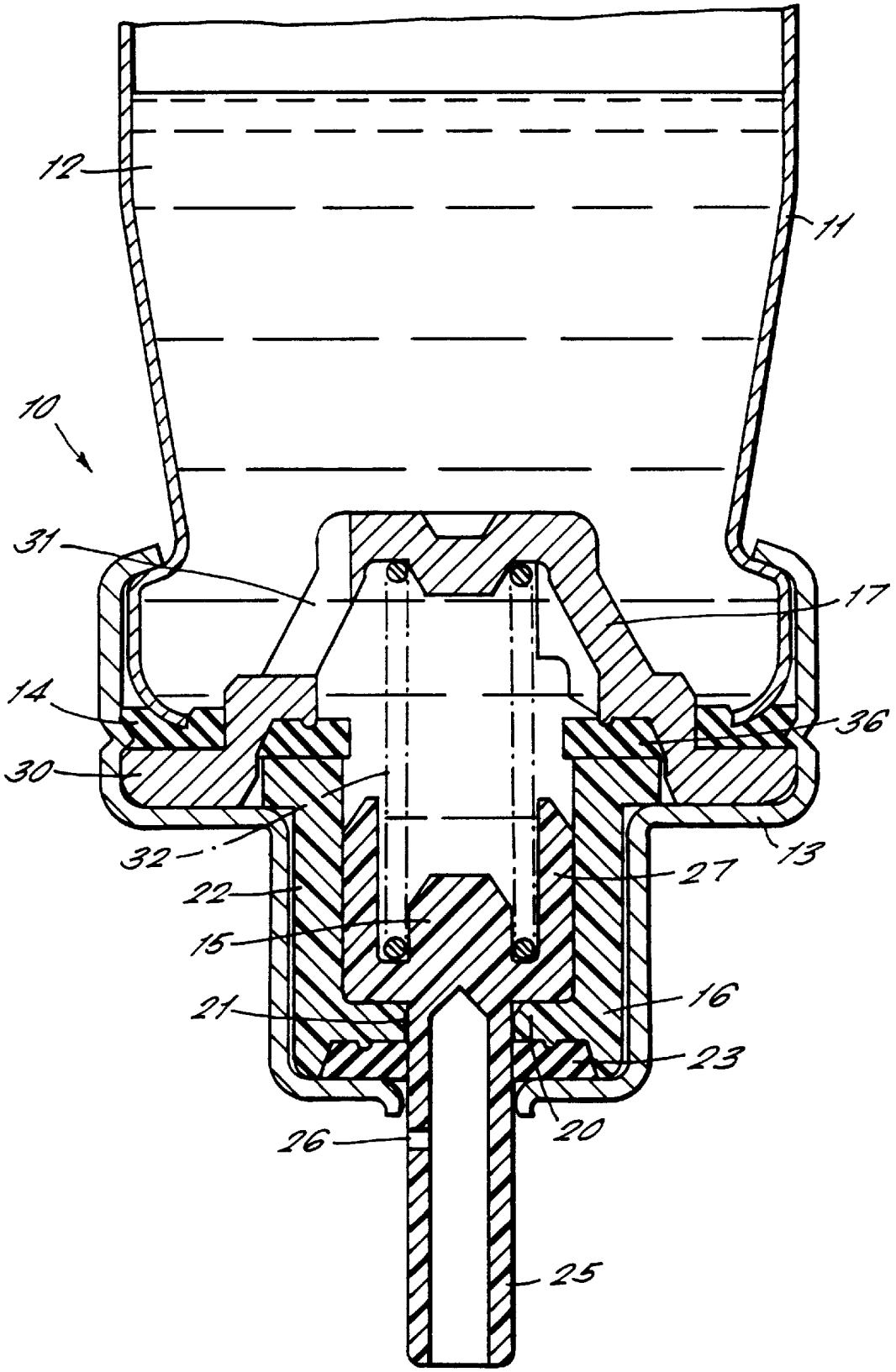
FIG. 1 shows a cross-sectional side elevation of dispensing apparatus according to the present invention.
Figure 2:
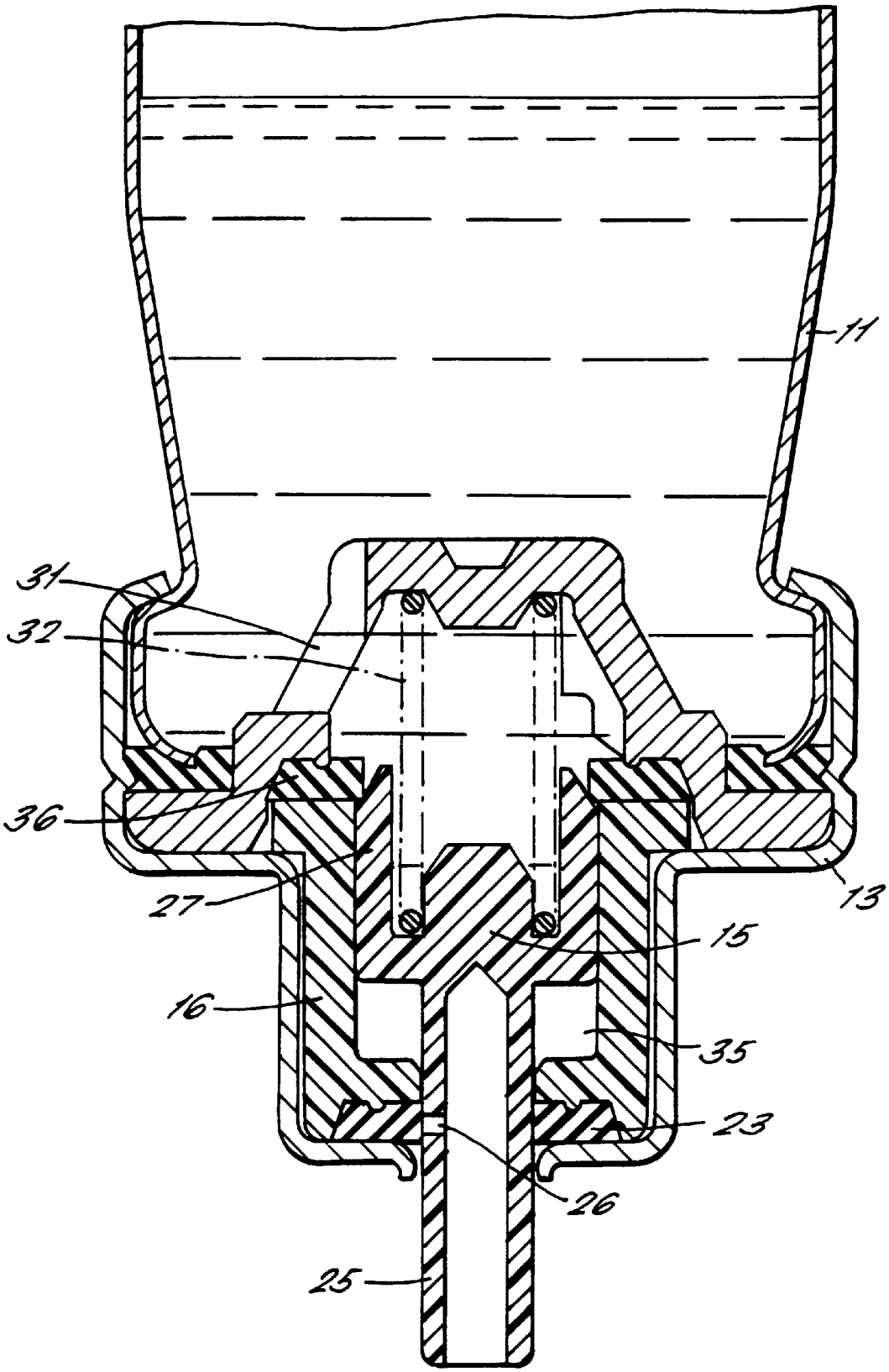
FIGS. 2 to 4 are cross-sectional side elevations of the dispensing apparatus of FIG. 1 showing the valve stem in increasing states of depression.

The dispensing apparatus 10 comprises a dispensing container 11 in which a product 12 to be dispensed in metered doses is stored. The product may be a liquid or a drug substance normally in suspension or other excipients or a product which is expelled using a liquidified propellant such as a CFC or HFA or blends thereof.

A valve is held in position to seal the dispensing container 11 by a cap or ferrule 13 which is crimped to the open neck of the container 11. An elastomeric sealing gasket 14 prevents leakage of the product 12 between the cap 13 and container 11.

The valve comprises a valve stem 15, which extends co-axially within a generally cup shaped valve body 16 and extends from the body 16 so as to be externally accessibly. The valve further comprises a housing 17.

The valve body 16, preferably of a polymeric material, has a base 20, in which is located an aperture 21, and side walls 22 defining the open end to the valve body 16. Sandwiched between the base 20 of the valve body 16 and the cap 13 is an elastomeric sliding seal 23 also having an aperture therein.

The valve stem 15, also preferably of a polymeric material, has at one end a generally hollow section 25 defining a dispensing channel in which portion 25 is located a port 26, and at its other end a piston 27 having a larger cross-sectional area than the hollow section 25. The hollow section 25 extends from the container 11 and the piston 27 is received in and slidable relative to the valve body 16. The external diameter of the piston 27 is selected to be smaller than the internal diameter of the valve body 16 thus leaving a radial clearance therebetween of, say, 0.03 to 0.08 mm.

The housing 17 covers off the open end of the valve body 16 and is secured in position by a flange portion 30 clamped between the cap 13 and the sealing gasket 14 located on the dispensing container 11. The housing 17 has entry ports 31 to allow the liquified product 12 to access the inside of the valve.

A return spring 32, preferably of stainless steel, is located between a base of the housing 17 and the piston 27 thereby urging the piston 27 in to contact with the base 20 of the valve body 16.

Figure 3:
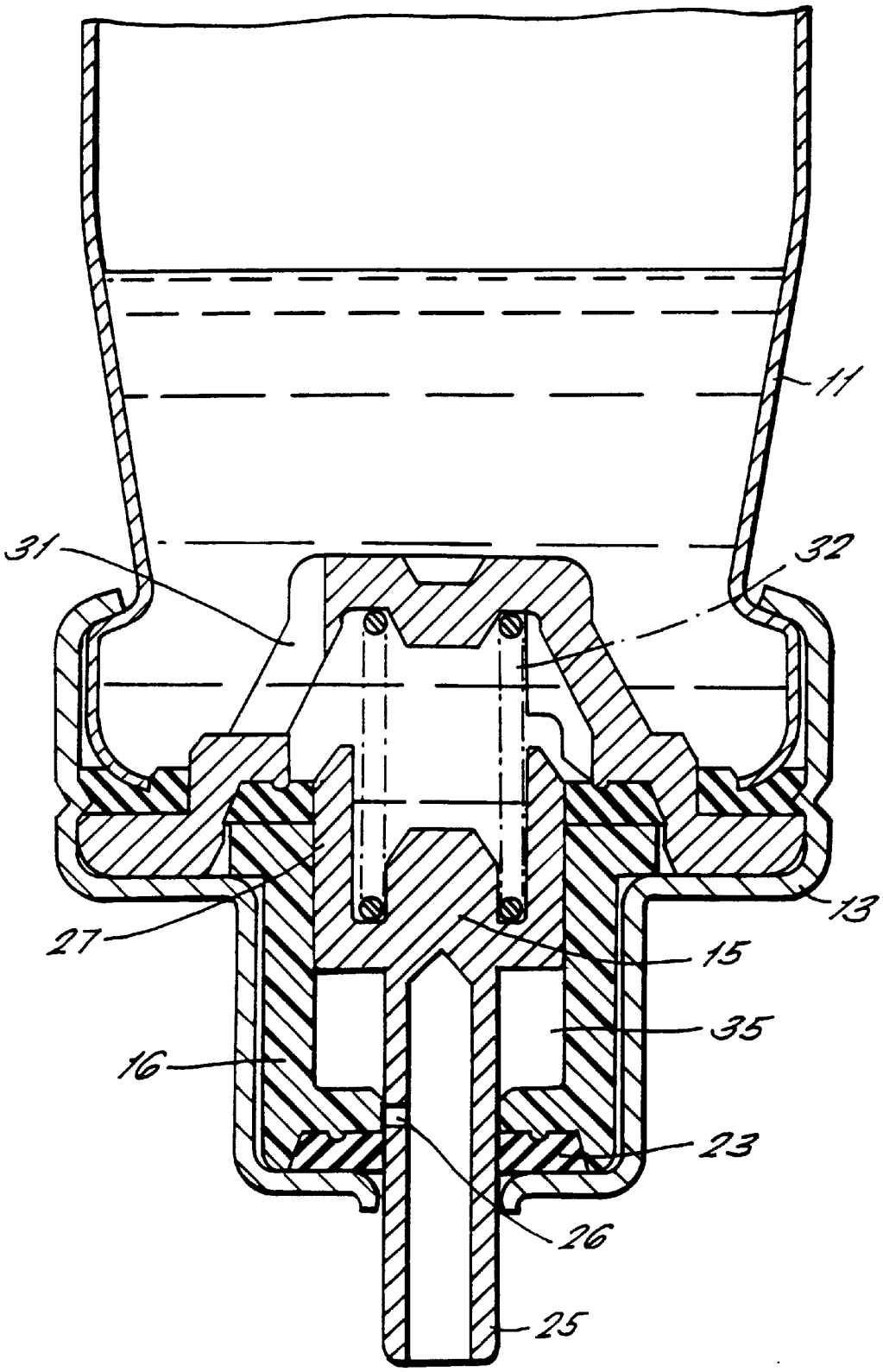
Figure 4:
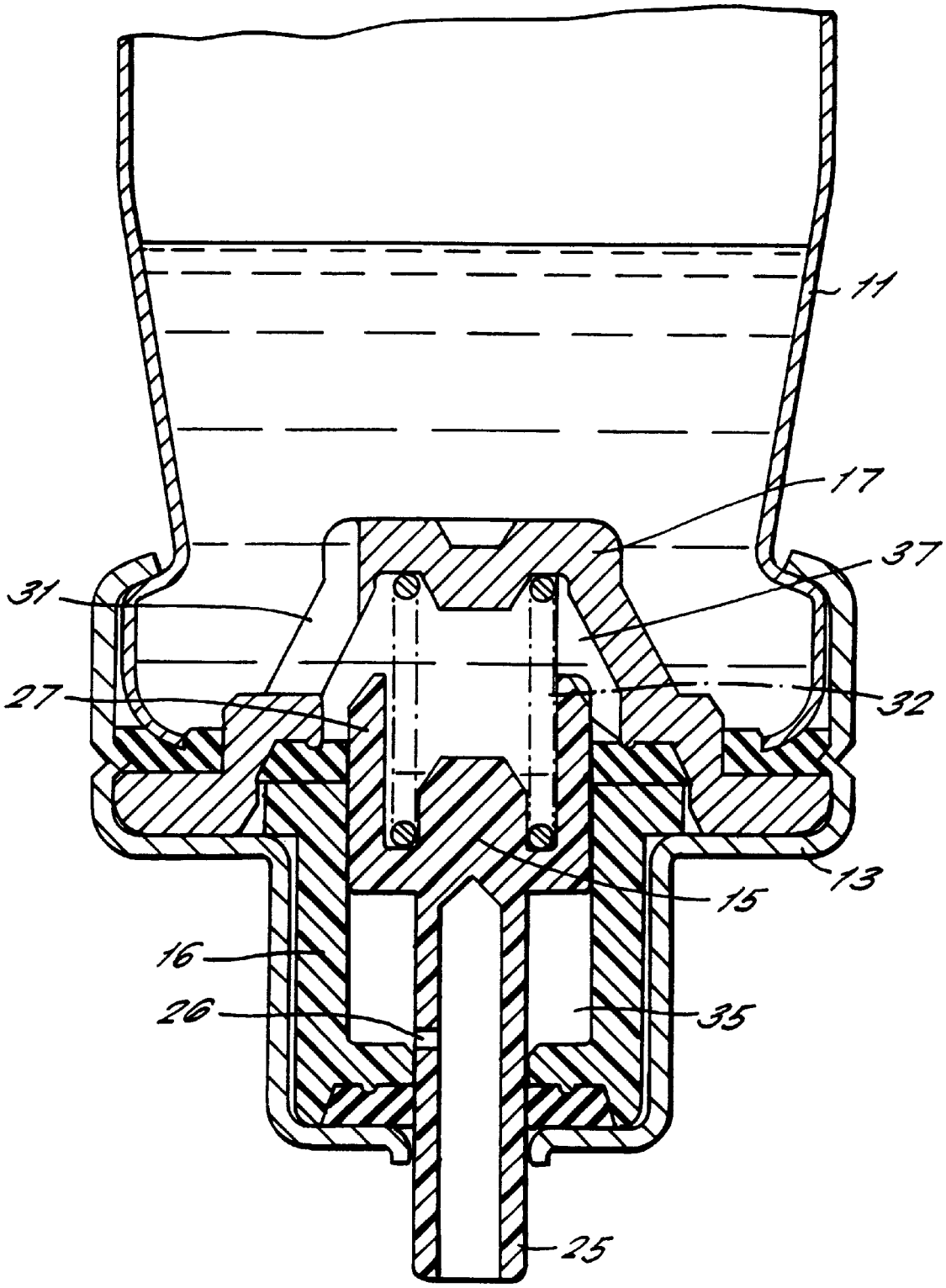

In use, the valve stem 15 is displaced axially relative to the valve assembly against the bias of the spring 32. As this occurs, a temporary chamber 35 is created between the valve stem 15 and the valve body 16. The product 12 is drawn through the clearance between the piston 27 and the valve body 16 and flows into the chamber 35 until a lower edge of the piston 27 contacts an inner seal 36 located between the housing 17 and valve body 14. A liquid-tight seal is created at that point of contact which prevents further ingress of the product 12. The metered dose of the product to be dispensed is defined by the volume of the chamber 35 and the clearance. Further depression of the valve stem 15 causes the port 26 in the hollow section 25 of the valve stem 15 to pass through the sliding seal 23 and into the chamber 35 (see FIGS. 3 and 4). The preferred propellant systems used in the dispensing means 10 are liquified gasses or combinations thereof having boiling temperatures significantly below room temperature. As a result, the product 12 boils evacuating the contents of the chamber 35 through the port 26 into the dispensing channel in the hollow section 25 of the valve stem 15 thus providing an exit path for the product 12.

At its maximum point of travel (shown in FIG. 4) the lower end of the piston 27 comes into contact with stop ribs 37 provided on the housing 17.

Release of the valve stem 15 allows the spring 32 to recover thereby forcing the valve stem 15 to return to its rest position and chamber 35 disappears as the piston 27 approaches the valve body base 20. Any product 12 left in the chamber 35 is forced to return to the dispensing container 11 via the clearance thereby preventing sedamentation.

Figure 5:
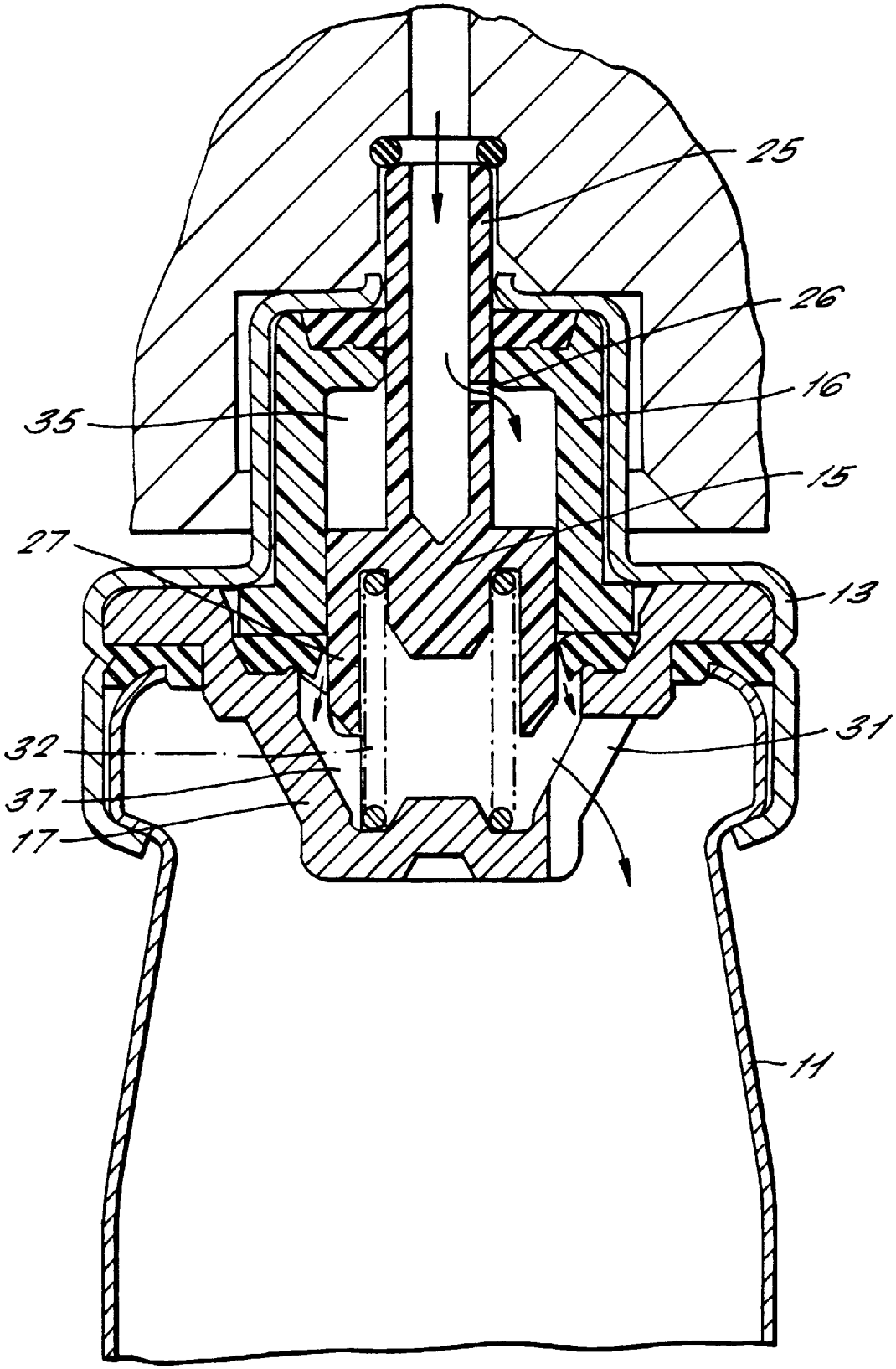
FIG. 5 is a cross-sectional side elevation of the dispensing apparatus of FIG. 1 undergoing filling.

FIG. 5 illustrates the pressure filling route for the valve assembly at the maximum point of displacement of the valve stem 15. The product 12 passes through the hollow section 25 of the valve stem 15, through the port 26 and into the chamber 35. The product 12 then passes along the clearance between the piston 27 and the chamber body 16 and passes into the space within the housing 17, through the orifices 31 and into the container 11.

Figure 6:
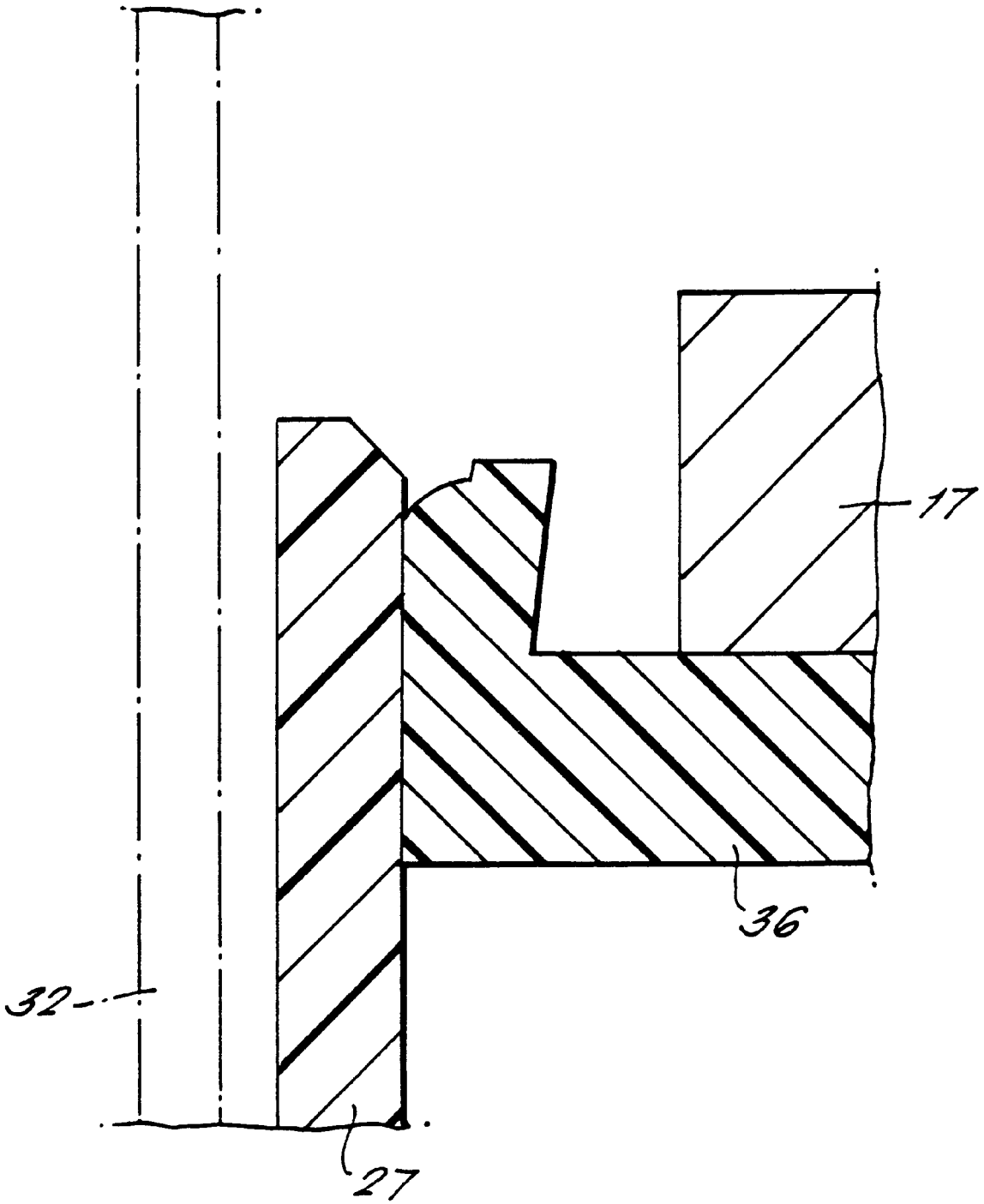
FIG. 6 is a cross-sectional side elevation of an alternative layout of the inner sealing arrangement of the dispensing apparatus of the present invention.

In an alternative embodiment of the invention, shown in FIG. 6, the inner seal 36 has an alternative construction which will more readily allow the use of thermo-plastic elastomers. In such an alternative arrangement, the main portion of the seal 36 is flat as before, but the area in contact with the piston 27 consists of a flexible cylindrical portion having a sealing bead which contacts the piston 27.

We claim:

1. Dispensing apparatus for dispensing a product from a container comprising metering valve means, the valve means comprising a valve stem having at one end piston means extending within and slidable relative to a cup shaped valve body, a clearance being provided between an outer surface of the piston means and an inner surface of the valve body to provide a path for said product, a spring member urging the piston means against a base of the valve body, such that movement of the valve stem against the spring action causes the piston means to move away from the base of the valve body to define a temporary metering chamber between the valve stem and valve body and product to flow from the container along said path to the metering chamber, the dispensing apparatus further comprising sealing means provided within the container such that as an end of the piston means moves into contact with said sealing means, the flow of product along the path is prevented and the product dispensed through an outlet in the valve stem.

2. Dispensing apparatus as claimed in claim 1 in which the clearance is an annular clearance in the range of 0.03 to 0.08 mm.

3. Dispensing apparatus as claimed in claim 1 in which the metering valve means further comprises a housing which covers an open end of the cup-shaped valve body.

4. Dispensing apparatus as claimed in claim 3 in which the housing supports the sealing means.

5. Dispensing apparatus as claimed in claim 3 in which the spring means are located between the housing and the piston means.

6. Dispensing apparatus as claimed in claim 3 in which the housing further comprises stop means which define the limit of travel of the valve stem.

7. Dispensing apparatus as claimed in claim 3 in which at least one port is provided in the housing to allow the product access to the inside of the valve means.

8. Dispensing apparatus as claimed in claim 1 in which the sealing means comprise an elastomeric annular sliding seal.

9. Dispensing apparatus as claimed in claim 1 in which the sealing means has a flexible cylindrical portion bearing a sealing bead which contacts the piston means to effect the seal.

10. Dispensing apparatus as claimed in claim 1 in which the piston means is open at one end.

11. Dispensing apparatus as claimed in claim 2 in which the metering valve means further comprises a housing which covers an open end of the cup-shaped valve body.

12. Dispensing apparatus as claimed in claim 11 in which the housing supports the sealing means.

13. Dispensing apparatus as claimed in claim 12 in which the spring means are located between the housing and the piston means.

14. Dispensing apparatus as claimed in claim 11 in which the spring means are located between the housing and the piston means.

15. Dispensing apparatus as claimed in claim 11 in which the housing further comprises stop means which define the limit of travel of the valve stem.

16. Dispensing apparatus as claimed in claim 11 in which at least one port is provided in the housing to allow the product access to the inside of the valve means.

17. Dispensing apparatus as claimed in claim 4 in which the spring means are located between the housing and the piston means.

18. Dispensing apparatus for dispensing a product from a container comprising metering valve means, the valve means comprising a valve stem having at one end piston means extending within and slidable relative to a cup shaped valve body, a clearance being provided between an outer surface of the piston means and an inner surface of the valve body to provide a path for said product, a spring member urging the piston means against a base of the valve body, such that movement of the valve stem against the spring action causes the piston means to move away from the base of the valve body to define a temporary metering chamber between the valve stem and valve body and product to flow from the container along said path to the metering chamber, the dispensing apparatus further comprising sealing means provided within the container, said piston means being movable into sealing contact with said sealing means to close the path between the piston means and the inner surface of the valve body, and an outlet in the valve stem for dispensing the product from the temporary metering chamber.

19. Dispensing apparatus as claimed in claim 18 in which the clearance is an annular clearance in the range of 0.03 to 0.08 mm.

20. Dispensing apparatus as claimed in claim 18 in which the sealing means includes an elastomeric annular sliding seal.

21. Dispensing apparatus for dispensing a product from a container comprising metering valve means, the valve means comprising a valve stem having at one end piston means extending within and slidable relative to a valve body, a clearance being provided between an outer surface of the piston means and an inner surface of the valve body to provide a path for said product, a spring member urging the piston means toward an end of the valve body, such that movement of the valve stem against the spring action causes the piston means to move away from said end of the valve body to define a temporary metering chamber between the valve stem and valve body and product to flow from the container along said path to the metering chamber, the dispensing apparatus further comprising sealing means provided within the container, said piston means being movable into sealing contact with said sealing means to close the path between the piston means and the inner surface of the valve body, and an outlet in the valve stem for dispensing the product from the temporary metering chamber.

22. Dispensing apparatus as claimed in 21 in which the clearance is an annular clearance in the range of 0.03 to 0.08 mm.

23. Dispensing apparatus as claimed in claim 21 in which the valve body is cup-shaped, and the metering valve means further comprises a housing which covers an open end of the valve body.

24. Dispensing apparatus as claimed in claim 23 in which the housing supports the sealing means.

25. Dispensing apparatus as claimed in claim 23 or claim 4 in which the spring means are located between the housing and the piston means.

26. Dispensing apparatus as claimed in claim 23 in which the housing further comprises stop means which define the limit of travel of the valve stem.

27. Dispensing apparatus as claimed in claim 23 in which at least one port is provided in the housing to allow the product access to the inside of the valve means.

28. Dispensing apparatus as claimed in claim 21 in which the sealing means comprise an elastomeric annular sliding seal.

29. Dispensing apparatus as claimed in claim 21 in which the sealing means has a flexible cylindrical portion bearing a sealing bead which contacts the piston means to effect the seal.

30. Dispensing apparatus as claimed in claim 21 in which the piston means is open at one end.

* * * * *